US005386995A

United States Patent [19]

Takemoto et al.

[11] Patent Number: 5,386,995

[45] Date of Patent: Feb. 7, 1995

[54] GAME MEDIUM CIRCULATION CONTROL SYSTEM

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 211,422

[22] PCT Filed: Oct. 4, 1991

[86] PCT No.: PCT/JP91/01355

§ 371 Date: Apr. 4, 1994

§ 102(e) Date: Apr. 4, 1994

[87] PCT Pub. No.: WO93/06902

PCT Pub. Date: Apr. 15, 1993

[51] Int. Cl.[6] ..... A63F 7/22

[52] U.S. Cl. ..... 273/148 R; 273/121 B; 273/143 R

[58] Field of Search ..... 273/143 R, 138 A, 85 CP, 273/121 B, 148 R

[56] References Cited

U.S. PATENT DOCUMENTS

| | | | |
|---|---|---|---|
| 4,636,951 | 1/1987 | Harlick | 273/138 A |
| 4,837,728 | 6/1989 | Barrie et al. | 273/143 R |
| 5,116,055 | 5/1992 | Tracy | 273/143 R |
| 5,222,583 | 6/1993 | Bergmann et al. | 194/206 |

FOREIGN PATENT DOCUMENTS

| | | |
|---|---|---|
| 56-70780 | 6/1981 | Japan . |
| 60-259288 | 12/1985 | Japan . |
| 62-24110 | 5/1987 | Japan . |

*Primary Examiner*—Benjamin H. Layno

*Attorney, Agent, or Firm*—Lowe, Price, LeBlanc & Becker

[57] ABSTRACT

A game apparatus, which is to be installed in an island unit consisting of a number of parallel arranged game machines, comprises: an upper game medium reservoir for supplying game mediums to the individual game machines via a supply conveyer; a game medium counter having a counting display; and a game medium polishing machine for collecting the game mediums from the game medium counter, the game medium polishing machine communicating with the game medium reservoir.

5 Claims, 3 Drawing Sheets

GAME MEDIUM CIRCULATION CONTROL SYSTEM

FIELD OF INVENTION

This invention relates to a game medium circulation control system, and more particularly to a slot-machine game apparatus which enables an automatic and effective control of medal circulation in units of islands each consisting of a number of parallel arranged slot machines.

BACKGROUND TECHNOLOGY

In this type of conventional slot-machine game apparatus, it is common practice for individual customers to bring medals gained from slot machines for prizes to an adjustment corner for adjustment and for these collected medals to be returned to the individual slot machines after being polished by a medal polishing machine.

However, it is inconvenient to individual customers to bring a lot of medals, which are heavy, to the adjustment corner. If it is crowded at the adjustment corner, the customers will have a long wait for adjustments. Further, it is laborious and time-consuming to return the adjusted and collected medals to the individual slot machines after polishing.

DISCLOSURE OF INVENTION

With the foregoing problems in view, it is an object of this invention to provide a game apparatus which enables an automatic and effective game medium or medal circulation control in units of islands. According to this invention, there is provided a game apparatus to be installed in units of islands each consisting of a number of parallel arranged game machines, the apparatus comprising: an upper game medium reservoir for supplying game mediums to the individual game machines via a supply conveyer; a game medium counter having a counting display; and a game medium polishing machine for collecting the game mediums from the game medium counter, the game medium polishing machine communicating with the game medium reservoir.

The game medium counter may be unitized with a printer or a card read/writer or may be equipped with a disburse button to be used in dispensing the game mediums after they are counted.

Therefore the medals gained from the individual game machines such as slot machines can be counted by the medal counter in units of islands and the value resulting from this counting can be indicated on the counting display. In the case where a printer or a card read/writer is connected to the medal counter, a premium coupon or a gift card is dispensed so that a customer can exchange it for a prize. To return the counted medals for reuse in a game, the disburse button is depressed so that the medals counted by the medal counter are conveyed, together with the spent medals discharged from the slot machines, to the medal polishing machine where the medals are polished and then successively conveyed to the upper medal reservoir. From the medal reservoir, the medals can be supplied to the individual slot machines by the supply conveyer. Thus it is possible to circulate game medals within a closed system, substantially without letting them out of the island.

PREFERRED EMBODIMENTS OF INVENTION

Figure 2:
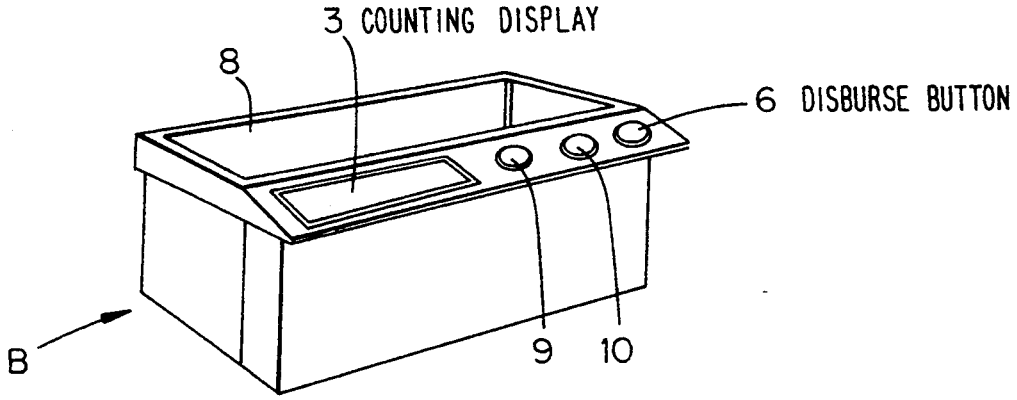
FIG. 2 is a perspective view showing a medal counter to be used in this invention.
Figure 3:
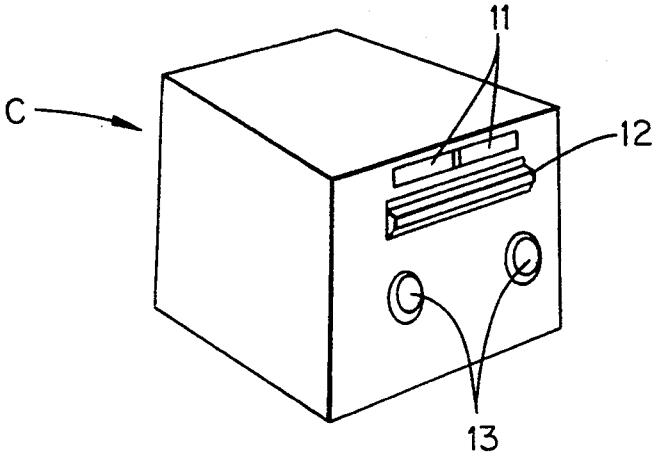
FIG. 3 is a perspective view showing a printer or a card read/writer to be used in this invention.

One embodiment of this invention will now be described with reference to FIGS. 1 through 3.

Figure 1:
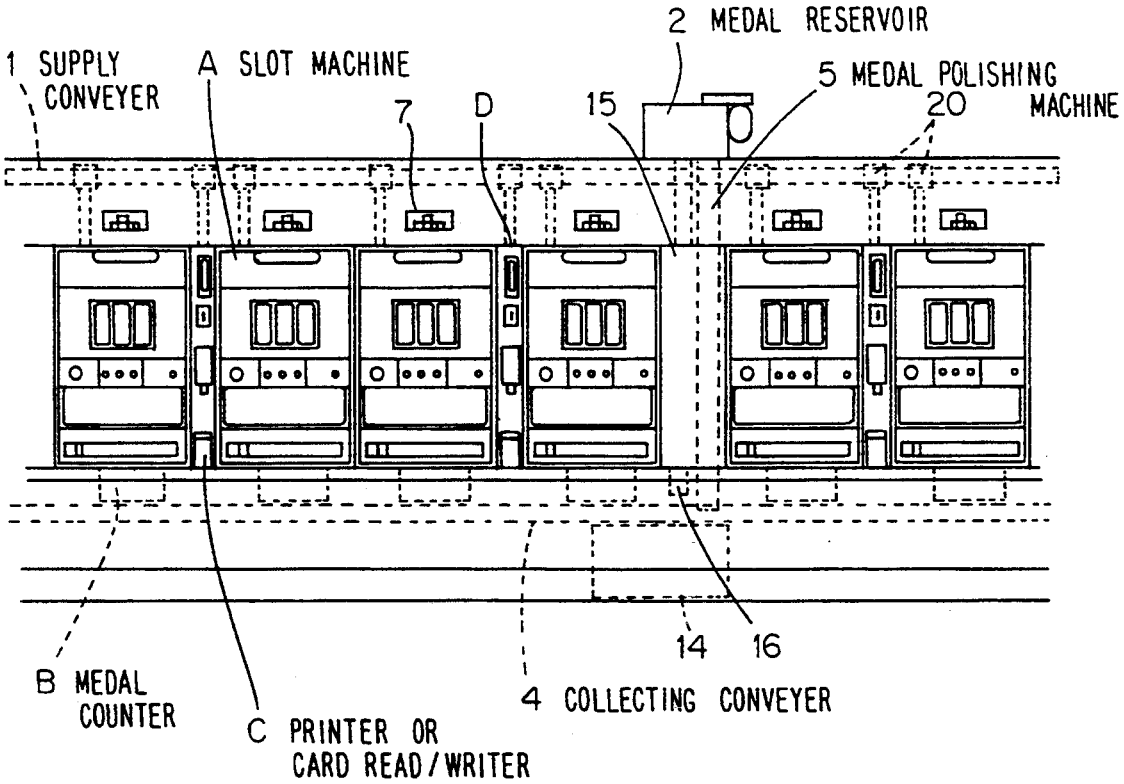
FIG. 1 is a fragmentary front view showing an island of slot machines in which a game apparatus according to one embodiment of this invention is incorporated.

FIG. 1 shows a portion of an island consisting of a number of parallel arranged slot machines, there being a medal dispenser D equipped between each pair of adjacent slot machines A, A so that an amount of game medals corresponding to the value of paper currency inserted can be dispensed. A supply conveyer 1, extending from an upper medal reservoir 2 disposed at an upper central portion of the island communicates with the individual slot machines A and the individual medal dispensers D via respective medal distributors 20. Above each slot machine A; a button switch 7 is disposed. Under each slot machine A, a medal counter B, which is equipped with a hopper 8, a counting display 3, an adjustment button 9, a counting start button 10 and a disburse button 6, is disposed. Under each medal dispenser D, a printer or a card read/writer C, which is equipped with a status display 11, a premium coupon outlet or a gift card outlet 12 and a card-reading-direction selecting switch 13, is disposed, communicating with the lower portion of the individual slot machine A via a conveyer. Under each medal counter B, a lower medal reservoir 14 is provided communicating with the medal counter B via a collecting conveyer 4. A medal polishing machine 5 is disposed between the upper and lower medal reservoirs 2, 14 for raising medals from the lower medal reservoir 14 to the upper medal reservoir 2 while polishing. Also between the upper and lower medal reservoirs 2, 14, a main reservoir 15 is disposed which is equipped at its lower portion with a quantitative disburse device 16.

In the case where it is unnecessary to issue a premium coupon for the adjustment of medals, the printer for issuing premium coupons may be omitted.

Figure 4:
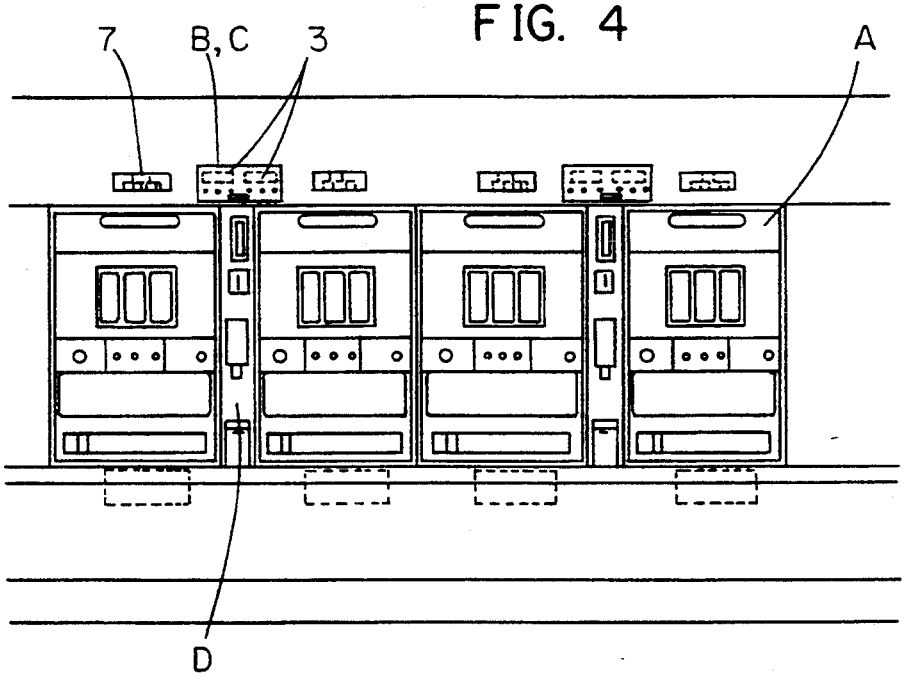
FIG. 4 is a fragmentary front view showing an island of slot machines in which a game apparatus according to another embodiment of this invention is incorporated.
Figure 5:
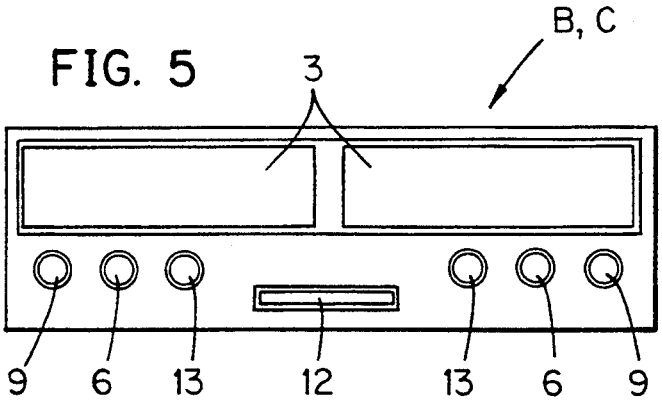
FIG. 5 is an enlarged view of a portion of FIG. 4.

FIGS. 4 and 5 shows another embodiment which is identical with the previous embodiment except for the following. In this embodiment, above each medal dispenser D there are disposed a medal counter B, which is equipped with two counting displays 3, two adjustment buttons 9, two disburse buttons 6, two card-reading-direction selecting switches 13 and two premium coupon or a gift card outlets 12, and a printer or a card read/writer C, which is unitized with the medal counter B.

Figure 6:
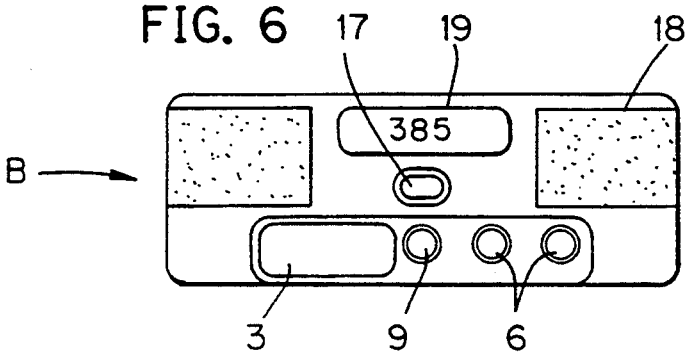
FIG. 6 is a modified medal counter to be used in this invention.

FIG. 6 shows a modified medal counter B which is equipped with, in addition to a counting display 3, an adjustment button 9 and two disburse buttons 6, a game machine number 19, a switch 17 and a call lamp 18.

Alternatively, a single medal counter B may be installed at one end of the island, or two medal counters may be installed at a central portion of the island, namely, at front and rear sides of the medal polishing machine.

When the medals gained from a slot machine A are put into the hopper 8, they are counted by the medal counter B and the result of this counting is indicated on the counting display 3. At that time, when the adjustment button 9 is depressed, a premium coupon or a gift card is dispensed from the outlet 12 of the printer or card read/writer C so that the customer may bring it to the adjustment corner for exchange with a premium or prize. To return the counted medals for reuse in the game, the disburse button 6 is simply depressed. The medals counted by the medal counter B are conveyed by the collecting conveyer 4 and are then polished and raised to the upper medal reservoir 2 by the medal polishing machine 5. Upon issuance of a supply request signal from the individual slot machine A or the medal dispenser D, the medals stored in the medal reservoir 2 are supplied to the slot machine A or the medal dispenser D by the supply conveyer 1, and keep being supplied until the signal is canceled. When the medal reservoir 2 is filled up with medals, the overflowing medals are conveyed to the main reservoir 15 from an overflow circuit. When the level in the medal reservoir 2 is lowered to activate a level sensor, the quantitative disburse device 16 acts to supply medals into the lower part of the medal polishing machine 5. The medals used by a customer are supplied to the hopper in the slot machine A. When the hopper is filled with the medals, the overflowing medals are conveyed to the collecting conveyer 4. On the contrary, when the level of the medals in the hopper is lowered to activate a level sensor, a medal supplier and the supply conveyer 1 are activated to continue the supply of medals until the signal is canceled. Also upon issuance of a supply request signal from the hopper of the medal dispenser D, the medal supplier and the supply conveyer 1 are activated to continue the supply of medals until the signal is canceled.

Thus the circulation of medals can be controlled in such a manner that medals are circulated within the island, and the need to remove them from the island is substantially obviated.

This invention can also applied to pachinko game machines. In such a case, it is possible to circulate pachinko balls as game mediums within a closed system, substantially without letting them be removed from the island.

UTILITY OF INVENTION

According to this invention, game mediums such as medals gained from individual game machines such as slot machines are counted in units of islands by the medal counter, and the medals counted by the medal counter are circulated, together with the spent medals discharged from the slot machines, while being polished by the medal polishing machine. Thus it is possible to circulate medals in the island efficiently, substantially free of letting them be removed from the island, so that the medals can be conveniently used by customers, thus realizing a game machine system such as a slot machine game apparatus having a good operativity. In the case where a premium coupon or a gift card corresponding to the number of gained medals is to be dispensed after counting, the customer may bring only it to the adjustment corner for exchange with a premium or prize. To return the counted medals for reuse in game, the disburse button is simply depressed.

We claim:

1. A game medium circulation control system having a plurality of game machines, which controls game mediums to be used in the game machines, comprising: a game medium counter for counting said game mediums, which is provided in each of said plurality of game machines; and a distributing/collecting means for distributing said game mediums which are used commonly in said plurality of game machines into each of said plurality of game machines and collecting the same from each of said game medium counters.

2. A game medium circulation control system according to claim 1, wherein said distributing/collecting means comprises: a game medium reservoir for storing game mediums which are used commonly in said plurality of game machines; a supply conveyer connected to said game medium reservoir for conveying game mediums for supply from said game medium reservoir; a game medium distributor for supplying game mediums conveyed by said supply conveyer to each of said plurality of game machines; a collecting conveyer for collecting the game mediums counted by said game medium counter; and a game medium polishing machine which communicates with said collecting conveyer and said game medium reservoir so as to supply said game mediums to said game medium reservoir.

3. A game medium circulation control system according to claim 1, further comprising a game medium dispenser for dispensing game mediums supplied to said game medium distributor, which is provided one for two of said game machines, said game medium dispenser having at least one of a printer and a card read/-writer which output the number of the game mediums counted by said game medium counter.

4. A game medium circulation control system according to claim 1, wherein said game medium counter has a counter display and a disburse button for dispensing counted game mediums; and said game machines dispenses game mediums supplied to said game medium distributor when said disburse button is depressed.

5. A game medium circulation control system according to claim 1, wherein said game medium counter has a printer and a card read/writer for outputting the number of game mediums respectively.

* * * * *